United States Patent [19]

Haruna et al.

[11] Patent Number: 4,964,343

[45] Date of Patent: Oct. 23, 1990

[54] PALLET IN FRICTIONALLY DRIVEN ROLLER TYPE TRANSFER APPARATUS

[75] Inventors: Hideaki Haruna; Hiroki Azeura, both of Hyoko, Japan

[73] Assignee: Tsubakimoto Chain Co., Osaka, Japan

[21] Appl. No.: 391,626

[22] Filed: Aug. 4, 1989

Related U.S. Application Data

[63] Continuation of Ser. No. 195,491, May 18, 1988, abandoned.

[30] Foreign Application Priority Data

Jul. 15, 1987 [JP] Japan ..... 62-107659
Jul. 15, 1987 [JP] Japan ..... 62-107660

[51] Int. Cl.[5] ..... B61B 13/12
[52] U.S. Cl. ..... 104/166; 104/165
[58] Field of Search ..... 104/166, 165, 168, 252, 104/253; 105/178; 74/25, 89

[56] References Cited

U.S. PATENT DOCUMENTS

| | | | |
|---|---|---|---|
| 3,818,837 | 6/1974 | Jacoby et al. | 104/166 |
| 4,347,792 | 9/1982 | Nagahori | 104/166 |
| 4,532,869 | 8/1985 | Kondo et al. | 104/166 |
| 4,583,462 | 4/1986 | Hale | 104/166 X |
| 4,691,641 | 9/1987 | Rohrbach et al. | 104/166 |
| 4,718,350 | 1/1988 | Jacoby et al. | 104/166 |

*Primary Examiner*—Johnny D. Cherry

*Assistant Examiner*—Joseph D. Pape

*Attorney, Agent, or Firm*—Dann, Dorfman, Herrell & Skillman

[57] ABSTRACT

Transfer apparatus having a pallet which is advanced along rails by a rotating shaft disposed between and parallel to the rails. The pallet has a roller frictionally engaging the shaft with its rotary axis adapted for adjustment between a position parallel to the shaft axis and a position transverse to the shaft axis such that the steeper the transverse angle, the faster the pallet is driven. The driven roller is mounted for gyratory adjustment by a lever having a forward end projecting from the pallet with a first roller to engage a stop plate on the preceding pallet which may actuate the lever to displace the roller axis towards the parallel position and thereby reduce the speed of the pallet and eventually stop the same as the pallet approaches the preceding pallet. A second roller is mounted on the lever to depend below the pallet so that it may engage a stop element fixed in the path of the second roller but out of the path of the remainder of the pallet. The pallet has one set of wheels engaging the first rail and a second set of wheels engaging a second rail. The second set of wheels, the driven roller and the lever are all mounted on a plate detachably secured to the underside of the pallet for adjustment to accommodate the pallet to the spacing between the rails.

17 Claims, 2 Drawing Sheets

PALLET IN FRICTIONALLY DRIVEN ROLLER TYPE TRANSFER APPARATUS

RELATED APPLICATION

This application is a continuation of U.S. patent application Ser. No. 195,491, filed May 18, 1988, now abandoned.

FIELD OF THE INVENTION

The present invention relates to improvements in a pallet in a frictionally driven roller-type transfer apparatus having a pair of spaced parallel rails and drive shaft having a rotating axis parallel to the rails. A driven roller frictionally engages the shaft to effect the pallet's movement along such rails.

BACKGROUND OF THE INVENTION

The present invention is an improvement upon the pallet conveying system shown in U.S. Pat. No. 4,532,869. Conventional pallets of this type have a drawback that it is not easy to change the sizes or the structures thereof and the manufacturing costs are high because, as seen in U.S. Pat. No. 4,532,869, they are fabricated from a machined one-piece element of plate-like material, or from an aluminum casting, or the like. Thus, it has been difficult to obtain most suitable pallets at reasonable prices.

Furthermore, as seen in the same U.S. patent, in order to stop the pallet upon the collision from behind, it has been conventional to use a stop lever projecting from the front end of the pallet having an actuator to move the lever so that it may cause the driven roller to gyrate or turn its roller axis when such a collision occurs. In order to stop the pallet in response to a separate limit stop, it has been conventional to provide a cam which may rotate upon abutment with the limit stop such that the rotation of the cam causes gyration of the driven roller, as seen in FIGS. 4 and 5 of said patent. Therefore, such a conventional apparatus has a drawback that it is structurally complicated and comprises many component parts.

It is possible to stop the pallet by letting the above-mentioned projecting stop lever abut against the separate limit stop; however, in such a case, since the forwardly projecting stop lever actuator must be in a position to abut the preceding pallet from behind, the separate limit stop is required to project upright at least as high as the stop lever actuator. However, in case of storing a number of pallets, each pallet is provided with an abutment for storage which is caused to abut against the actuator on the lever, and consequently, should the separate limit stop project so that it may contact the said actuator, it will inevitably collide against the abutment provided for the above-mentioned storage. Therefore, the separate limit stop must be manipulated into the path of travel of the actuator after detecting the passage of the preceding pallet and within the time period until the next pallet arrives, which is cumbersome, and in the case where a plurality of pallets are in series contact with each other, such a separate limit stop may not be used to stop any of the intermediate pallets of the series.

The object of this invention is to provide a pallet in which the above-mentioned problems have been solved.

SUMMARY OF THE INVENTION

A primary feature of the present invention is to provide a simplified pallet for a frictionally driven roller-type transfer apparatus comprising an upper plate for carrying articles, supporting rollers detachably secured to one side of the lower surface of said upper plate to ride on one rail of the pair, a base plate detachably secured to the lower surface of said upper plate, said base plate being provided with supporting rollers positioned at another side of the lower surface of said upper plate to ride on the other rail of the pair, guide rollers adapted to contact side faces of a guide rail, a frictionally driven roller adapted to be urged against a driving shaft in such a manner that the axis of rotation of said driven roller normally is transverse to the axis of the driving shaft, and a stop lever which normally projects from one end of the pallet and may be gyrated so that it may cause the axis of rotation of the driven roller to be parallel to that of the driving shaft.

In accordance with the first feature of the invention, it is possible to easily select a pallet having an upper plate which is the most suitable for carrying the desired article, for use with the same transfer apparatus. By mounting the above-mentioned supporting rollers and the base plate equipped with the above-mentioned components to the upper plate of appropriate size and structure, it may accommodate itself to the rails and drive shaft of the transfer apparatus. This free selection is possible since, in accordance with the first feature of the invention as mentioned above, the supporting rollers as well as the base plate provided with the various components are detachably secured to the upper plate for carrying articles.

A second feature of the present invention is in providing for transfer apparatus of the type described: a pallet-stopping assembly comprising a horizontal gyratory support means for the driven roller; a stop lever, the proximal end of which is pivotally connected to the pallet and the distal end of which normally projects from one end of said pallet and pivotally supports an upper roller and a lower roller, respectively; and a rod connecting said support means and the lever.

In accordance with the second feature of the invention, the upper roller may be used for the purpose of storage of the pallets or stopping or reducing the speed of a pallet when it collides with the preceding pallet. Thus, a stop plate abutment may be provided on each pallet at such a height that the upper roller of the next pallet abuts against it from behind. The lower roller may be used for the purpose of stoppage by means of a separate limit stop, which means that the height of the separate limit stop may be as low as the lower roller. Consequently, the separate limit stop should not collide against either the lever or the stop plate abutment provided for the storage purpose, thus making it possible to let the separate limit stop project into the traveling path of the lower roller on the pallet to stop the pallet at any time even while the pallet is running.

BRIEF DESCRIPTION OF THE DRAWINGS

The objects of the invention will be set forth more fully in the following description, when read in conjunction with the attached drawings, in which.

DESCRIPTION OF THE PREFERRED EMBODIMENT

Figure 1:
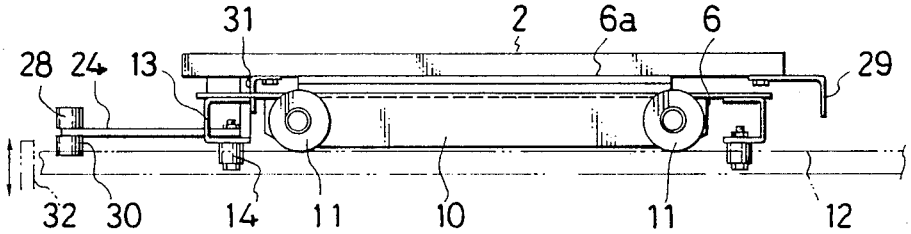
FIG. 1 is a side elevational view of a pallet made according to the present invention.

A conveying pallet 1 according to the present invention includes an upper plate 2 for carrying various articles, supporting rollers 3,3 disposed at one side of the lower surface of the plate 1 supported by metal fittings 4,4 which are detachably secured to the plate 2 by means of bolts 5,5. Also, at the other side of the lower surface of the plate 2, a base plate 6 is detachably secured by means of bolts 7,7 with a spacer 6a therebetween. The base plate 6 is provided with a reinforcing rib 8 at the central side of the plate 2 as well as another reinforcing rib 10 at the other side excepting flattened portions 9,9 at the forward and rear ends. Another set of supporting rollers 11,11 are provided at the respective forward and rear ends of the rib 10. The supporting rollers 3,11 are adapted to roll on the upwardly-facing flat surface of a rail 12; and a pair of guide rollers 14,14 are disposed on the metal fittings 13,13 secured to the flattened portion 9,9, respectively, so that the said rollers 14 may contact the respective sides of the guide rail 12 and thereby serve as guide means to maintain the supporting rollers on the rail.

Figure 2:
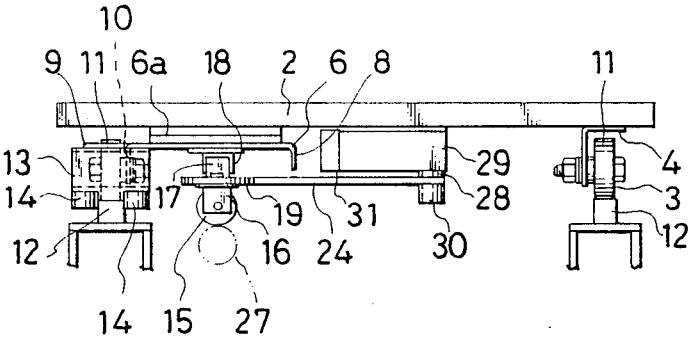
FIG. 2 is a rear elevational view.

A frictionally driven roller 15 is positioned at an intermediate position between the ribs 8,10. Mounting means 16 for the driven roller 15 includes a rotatable post 17 which may be rotated about a vertical axis which is received at its upper end in a bearing receiver 18 which is in turn fixed to the lower surface of the base plate 6. The mounting means 16 is urged by a spring (not shown) toward a drive shaft 27 of the transfer apparatus and is held captive, so as not to fall off. (See FIG. 2.) The post 17 has a horizontal gyratory supporting frame 19 for the mounting means 16, the frame having a plurality of pins 20 spaced circumferentially around it. Between one of said pins 20 and a fitting 21 secured to the lower surface of the base plate 6 is disposed a tension spring 22; and to another of said pins is connected a connecting rod 25 pivoted to a stop lever 24 which is pivotally supported by the base plate 6 by means of a pin 23. Adjacent the pin 23, the lever 24 has an end surface 24a made to contact a stop 26 fixed to the base plate 6. With this particular arrangement, the axis of rotation 15a of the driven roller 15 is transverse to the axis of rotation of the drive shaft 27 at the angle 45 degrees. Since the driven roller 15 is urged against the drive shaft 27 located immediately below, the driven roller 15 may be frictionally rotated by the drive shaft 27, and, as a result of the frictional engagement, the pallet 1 may be conveyed either forward or backward depending upon the direction of rotation of the driving shaft 27.

The distal end of the lever 24 normally projects forward from the upper plate 2 and supports an upper roller 28 and a lower roller 30 at the respective upper and lower sides thereof. When the pallet 1 moves forward and the upper roller 28 comes into abutment with collision abutment 29 provided at the rear end of an upper plate 2 of a preceding pallet causing the lever to be rotated backward, so that the driven roller 15 is caused to gyrate counterclockwise in FIG. 3 with the resultant decreased crossing angle between the axis of rotation 15a and the axis of rotation of the drive shaft 27. Thus, the running speed of the pallet 1 along the rails 12,12 is reduced. The abutment displaces the roller 28 counterclockwise on the pin 23 until it abuts against a gyration limit means 31, at which point said crossing angle becomes zero, and the pallet 1 comes to a standstill. The abutment 29 and the limit means 31 permit the pallet to come into contact with the preceding pallet, and the pallets may be stored in closely-stacked relationship.

Figure 3:
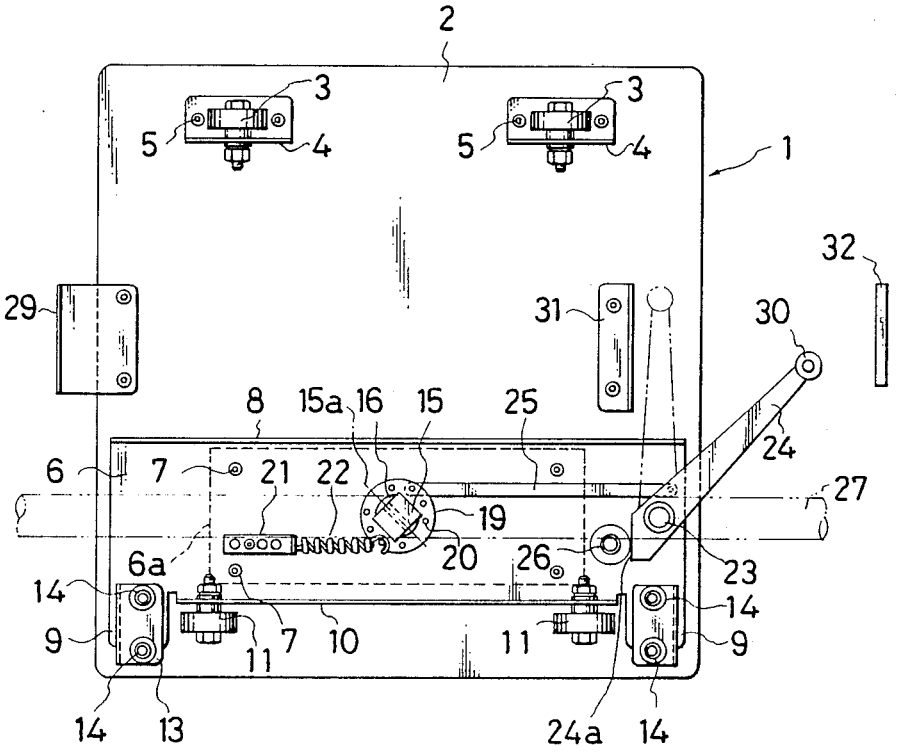
FIG. 3 is a bottom view of the pallet shown in FIG. 1.

The adjustment of the roller axis 15a from the transverse position shown in FIG. 3 toward a position parallel to the axis of the drive shaft 27 effects a gradual slowing of the drive imparted by the roller 15. Thus, if the preceding pallet slows but does not stop, the engagement of the roller 28 with the abutment 29 of the preceding pallet reduces the speed of the pallet until it matches the speed of the preceding pallet. This provides a gentle stopping motion without need for complex speed-compensating mechanism.

If it is desired to stop the pallet 1 by means of a separate fixed abutment 32, the abutment 32 may be projected into the traveling path of the pallet 1 to such a height that it may abut against roller 30. The roller 30 depends below the arm 24, and is the lowest component of the pallet between the rollers 11 and 15. If the abutment 32 is raised into position after the roller 30 has passed by, the stop abutment 32 does not project as high as the arm 24 so that it does not interfere with the running pallet, since the limit means 31 and the abutment 29 will not contact the stop abutment 32. In such case, the immediately next pallet may be stopped in a similar manner as mentioned before. If it is desired to incapacitate the fixed abutment for a selected pallet, the lower roller 30 may be omitted from that pallet. To this end, the roller 30 has detachable mounting means securing it to the lever.

If it is desired to change the size, shape, etc., of a pallet, it may be easily accomplished by detaching fittings 4,4 as well as the base plate 6 and securing them to another upper plate of the desired size or shape. If the spacing between the rails is changed, the base plate may be adjusted relative to the fittings 4,4.

If it is desired to provide a pallet without an independent drive, the base plate 6 may be replaced with roller fittings 4. Since the operating parts of the drive mechanism for each pallet is confined to the base plate 6, maintenance may be accomplished by simply removing the base plate 6 for repair or replacement.

We claim:

1. A pallet driven along a pair of spaced parallel rails having a rotating drive shaft disposed parallel thereto, said pallet comprising:

an upper plate to support articles thereon for conveyance;

supporting rollers mounted on the underside of said upper plate to roll along one of said rails;

a base plate detachably mounted on said upper plate to overlap the other of said rails and said parallel drive shaft, said base plate having mounted on the undersurface thereof:

(a) supporting rollers to roll along the other of said rails, (b) guide means positioned to engage opposite side faces of said other rail to maintain said supporting rollers in position thereon, (c) a driven roller in driving engagement with said drive shaft so as to be rotated about the axis of rotation of said driven roller, (d) means mounting said driven roller so that the roller axis may be adjusted between a first position in which said roller axis is parallel to said drive shaft axis and a second position in which said roller axis is transverse to said drive shaft axis, and (e) a stop lever connected to said mounting means and having an end projecting beyond one end of said pallet to afford adjustment of said roller axis;

said driven roller operating to advance said pallet along said rails when said roller axis is transverse to said drive shaft axis and to arrest travel of said pallet along said rails when said roller axis is parallel to said drive shaft axis.

2. A pallet according to claim 1 including an abutment mounted on the pallet at the end opposite to the end from which said stop lever projects, said abutment being aligned with the projecting end of said stop lever, whereby it is positioned in the path of movement of the projecting end of the stop lever of a succeeding pallet traveling on said rails.

3. A pallet according to claim 1 including a spring on said base plate biasing said stop lever toward an extended position wherein said roller axis is transverse to said driving shaft axis, said spring means allowing retraction of said stop lever to a retracted position which effects adjustment of said roller axis into said first position wherein it is parallel to the axis of said drive shaft.

4. A pallet according to claim 3 including a connecting rod extending generally parallel to said rails connected to said stop lever at its forward end and to said roller-mounting means at its rear end, said stop lever having an actuator roller mounted on its forward end constructed and arranged to effect retraction of said stop lever when said actuator roller engages an abutment in the path of travel of the actuator roller.

5. A pallet according to claim 4 for use with a fixed abutment which may be projected into a position below the traveling path of said stop lever wherein said actuator roller projects upwardly from said stop lever to intercept the path of travel of a preceding pallet on the rails and including a second roller projecting downwardly from said stop lever operable to engage said fixed abutment in its projected position to effect rotation of said stop lever.

6. A pallet according to claim 3 wherein said base plate includes a limit stop defining said extended position in which said lever positions said driven roller axis at an angle of generally 45° to the drive shaft axis.

7. A pallet according to claim 3 wherein said pallet includes a limit abutment cooperable with the projecting end of the stop lever to define said retracted position in which said lever positions said driven roller axis parallel to the drive shaft axis.

8. A pallet apparatus comprising a pair of spaced parallel rails having a rotating drive shaft disposed parallel thereto, at least two pallets driven in a path of travel along said rails by said drive shaft, and a fixed abutment positioned adjacent said rails and projectable into a position in said path of travel, each of said pallets comprising:

(a) an upper plate adapted to support articles thereon for conveyance and a base plate detachably mounted on said upper plate, said plates spanning between said rails and overlapping said drive shaft;

(b) support means on said upper and base plates supporting said pallet on and guiding said pallet along said rails;

(c) a driven roller in driving engagement with said drive shaft so as to be rotated about the roller's axis of rotation, (d) means mounting said roller so that the roller axis may be adjusted between a first position in which said roller axis is parallel to said drive shaft axis and a second position in which said roller axis is transverse to said drive shaft axis, said driven roller operating to advance said pallet along said rails when said roller axis is transverse to said drive shaft axis and to arrest travel of said pallet along said rails when said roller axis is parallel to said drive shaft axis, (e) a stop lever having an end projecting beyond one end of said pallet and connected to said mounting means to afford adjustment of said roller axis, said stop lever having first and second positions corresponding respectively to the first and second positions of said roller axis; and (f) the projecting end of said stop lever having an upwardly projecting actuator positioned in the path of travel of a preceding pallet on the rails and a second actuator projecting downwardly to engage said fixed abutment in its projected position, said projected position being in the path of travel of said second actuator in both the first and second positions of said stop lever, whereby said stop lever may be displaced either by the preceding pallet or by the fixed abutment, and said pallet is positively arrested by said fixed abutment in its projected position.

9. A pallet apparatus according to claim 8 including a spring biasing said stop lever toward said second position wherein said roller axis is transverse to said driving shaft axis, said spring means affording retraction of said stop lever to a retracted position and effecting adjustment of said roller axis into said first position wherein it is parallel to the axis of said drive shaft.

10. A pallet apparatus according to claim 9 including opposite limit stops for said stop lever, one of said limit stops positioning said lever in said first position, and the other limit stop positioning said lever in said second position, in which said roller axis is generally at an angle of 45° to the drive shaft axis.

11. A pallet apparatus according to claim 8 wherein said second actuator is detachably mounted to said stop lever.

12. A pallet apparatus according to claim 8 wherein each support means includes rollers on the upper plate to cooperate with one of said rails and rollers on the base plate to support the other of said rails.

13. A pallet apparatus comprising a pair of spaced parallel rails having a rotating drive shaft disposed parallel thereto, a plurality of pallets driven in a path of travel along said rails by said drive shaft, and a plate-like abutment positioned in a lowered position adjacent said rails below the path of travel of said pallet and projectable upwardly into a transverse raised position in said path of travel, at least one of said pallets comprising:

(a) a plate to support articles thereon for conveyance;

(b) support means to guide said pallet along said rails;

(c) a driven roller in driving engagement with said drive shaft so as to be rotated about the roller's axis of rotation, (d) means mounting said roller so that the roller axis may be adjusted between a first position in which said roller axis is parallel to said drive shaft axis and a second position in which said roller axis is transverse to said drive shaft axis, said driven roller operating to advance said pallet along said rails when said roller axis is transverse to said drive shaft axis and to arrest travel of said pallet along said rails when said roller axis is parallel to said drive shaft axis, (e) a stop lever having an end projecting beyond one end of said pallet and connected to said mounting means to afford adjustment of said roller axis between said first and said second positions; and (f) the projecting end of said stop lever having an upwardly projecting actuator positioned in the path of travel of a preceding pallet on the rails and a second actuator projecting downwardly to engage said fixed abutment in its raised position, said preceding pallet upon engagement with said upwardly projecting actuator operable to displace said stop lever from a second position corresponding to the second position of said roller axis toward a first position corresponding to the first position of said roller axis, said raised position of said plate-like abutment being in the path of travel of said second actuator, and said lowered position of said plate-like abutment being below the path of said second actuator.

14. A pallet apparatus according to claim 13 wherein said second actuator is detachably mounted on said stop lever, and said raised position of said plate-like abutment being below the stop lever.

15. A pallet apparatus according to claim 13 wherein said plate-like abutment is displaceable from its lowered position to its raised position after the second actuator of one pallet has passed by said abutment to stop the immediately next pallet.

16. A pallet apparatus according to claim 13 wherein said stop lever is pivoted on an upright pin on said pallet for dispalcement within a horizontal plane, and in said raised position said abutment is in the path of said second actuator throughout the displacement of said projecting end of said stop lever between said second and first positions.

17. A pallet apparatus according to claim 13 wherein each support means includes rollers on the upper plate to cooperate with one of said rails and rollers on the base plate to support the other of said rails.

* * * * *